US009272562B2

(12) United States Patent
Ganter

(10) Patent No.: US 9,272,562 B2
(45) Date of Patent: Mar. 1, 2016

(54) BOOK FORMING AND PRESSING MACHINE

(71) Applicant: Mueller Martini Holding AG, Hergiswil (CH)

(72) Inventor: Christian Ganter, Bieberehren (DE)

(73) Assignee: Mueller Martini Holding AG, Hergiswil (CH)

( * ) Notice: Subject to any disclaimer, the term of this patent is extended or adjusted under 35 U.S.C. 154(b) by 323 days.

(21) Appl. No.: 13/859,908

(22) Filed: Apr. 10, 2013

(65) Prior Publication Data

US 2013/0266401 A1 Oct. 10, 2013

(30) Foreign Application Priority Data

Apr. 10, 2012 (CH) ..... 0497/12

(51) Int. Cl.
*B42C 13/00* (2006.01)
*B42C 5/00* (2006.01)

(52) U.S. Cl.
CPC . *B42C 13/00* (2013.01); *B42C 5/00* (2013.01); *B42C 13/003* (2013.01)

(58) Field of Classification Search
CPC ..... B42C 5/02; B42C 13/00; B42C 13/003
USPC ..... 412/22, 23, 30, 900
See application file for complete search history.

(56) References Cited

U.S. PATENT DOCUMENTS

| | | | | |
|---|---|---|---|---|
| 2,516,460 | A * | 7/1950 | Getzoff | 412/30 |
| 6,250,868 | B1 * | 6/2001 | Schmucker | 412/902 |
| 2008/0136158 | A1 * | 6/2008 | Brommer et al. | 281/23 |
| 2008/0138172 | A1 * | 6/2008 | Brommer et al. | 412/22 |
| 2008/0138173 | A1 * | 6/2008 | Brommer et al. | 412/22 |

FOREIGN PATENT DOCUMENTS

| | | | |
|---|---|---|---|
| DE | 4422783 | A1 | 1/1996 |
| EP | 0309736 | A2 | 4/1989 |
| EP | 1674285 | A1 | 6/2006 |
| EP | 1942009 | A1 | 7/2008 |

OTHER PUBLICATIONS

International Search Report of CH 4972012 Dated August 13, 2012 With an English Translation.

* cited by examiner

*Primary Examiner* — Kyle Grabowski
(74) *Attorney, Agent, or Firm* — Robert Kinberg; FisherBroyles LLP

(57) ABSTRACT

A book forming and pressing machine includes a pressing device that has a number of spaced-apart pressing plates, joint-burn-in rails and at least one station for accommodating a book block. A loading device has a loading table. A reshaping device includes a mechanism to shape a front cut of a book block. The mechanism includes a tool carrier having a shaping tool to shape the front cut. Tool carrier and/or the shaping tool executes a series of movements in one plane or in three-dimensional space, relative to the front cut to be shaped, while the book block is held in the pressing device.

22 Claims, 5 Drawing Sheets

BOOK FORMING AND PRESSING MACHINE

CROSS-REFERENCE TO RELATED APPLICATION

This application claims the priority of Swiss Patent Application No. 00497/12, filed on Apr. 10, 2012, the subject matter of which is incorporated herein by reference.

BACKGROUND OF THE INVENTION

The invention relates to a book forming and pressing machine that includes a reshaping device, a pressing device, and a loading device. The loading device basically is a loading table and the pressing device includes a number of spaced-apart pressing plates and joint-burn-in rails, wherein the reshaping device includes a mechanism that shapes a front cut of a book block. The invention furthermore relates to a method for operating a book forming and pressing machine of this type.

A book forming and pressing machine is known from German patent document DE 4422783 A1, which discloses a number of pressing devices with thereon arranged joint-burn-in devices that are arranged on a rotor, driven intermittently around a vertical axis of rotation. In a feed-in station, the book blocks are fed into a pressing device where they are accommodated completely and are formed or bound-in continuously with the aid of the joint-burn-in rail. The book blocks are held continuously in the same pressing jaw until they are discharged at the discharge station. Between the feeding of the book blocks encased in covers and the discharge of the fully formed and pressed books, the rotor executes some intermittent rotational movements, wherein this interval is utilized for the forming and/or the joint-burn-in.

If the joint-burn-in rails are closed only slightly and the pressing plates are closed with or without exerting pressure, a loading plunger functioning as joint-burn-in rail of a reshaping device is then lowered against the front cut and presses the book block toward the back. As a result, the two book cover sections are pulled via the back insert and the fly leaf in the joint against the joint-burn-in rails. The book block and the book cover can thus be oriented relative to each other while the book is reshaped at the same time. Separate inserts for the shaping inserts are used in this case for producing books with either rounded or flat backs.

An additional feature of this book forming machine, as well as nearly all book forming and pressing machines currently being marketed, is that the complete machine is provided with a cover for safety reasons and that only the intake belt and the discharge belt extend out of the housing, so that when replacing a forming insert, for example for the changeover from a flat back to a rounded back or when changing to an insert having different dimensions to achieve an improved rounding, the machine must be powered down, the cover must be opened and the machine must subsequently be restarted.

SUMMARY OF THE INVENTION

An object of the invention is to solve the foregoing problem. It is a further object of the invention to create a book forming and pressing machine with a reshaping device configured such that, depending on the embodiment of the front cut of the book block and/or the book block back, a selected reshaping tool can be automatically employed.

According to an embodiment of the invention, there is provided a book forming and pressing machine, comprising:

a pressing device including a number of spaced-apart pressing plates, joint-burn-in rails and at least one station for accommodating a book block; a loading device including a loading table; and a reshaping device including a mechanism to shape a front cut of a book block, the mechanism including at least one tool carrier having at least one shaping tool to shape the front cut, wherein at least one of the tool carrier and the shaping tool executes a series of movements in one plane or in three-dimensional space, relative to the front cut to be shaped, while the book block is held in the pressing device.

According to a further embodiment, the reshaping device includes a tool carrier equipped with exchangeable forming or shaping rails or inserts for books with flat or rounded backs and the like, wherein these forming rails push during the shaping operation against the front cut and thus reshape the book block back.

In one embodiment, elements of the reshaping device and/or the tool carrier in this case are embodied such that they can at least be moved in horizontal and vertical directions, relative to the front cut of the clamped-in book block, meaning they at least cover the X- and Y-plane.

In addition, the reshaping device according to the invention may be designed such that the tool carrier belonging to the reshaping device, which generally includes a basic device and at least one tool, operates in the plane for the front cut of the clamped-in book block.

In one embodiment, the tool carrier may execute a rotational movement, wherein several tools, meaning forming rails, are arranged tangentially in a circumferential direction of the tool carrier, meaning along a circular arc. The tool carrier thus, per se, serves to store the forming rails which can be called up and/or made operational from time to time without requiring a conversion operation.

In principle, however, the tool carrier belonging to this reshaping device is not restricted to such an embodiment. The reshaping device basically always consists of at least one tool carrier, which can also be embodied differently and is provided with at least one tool, meaning a forming rail, for shaping the front cut. The tool carrier and/or the tool may execute a sequence of movements in a plane or in three-dimensional space, relative to the front cut, wherein this sequence of movements can differ per se, depending on the type of tool carrier, and wherein this sequence of movements can be machine controlled, freely programmable and/or guided by a sensor.

According to one embodiment, the book block, resting on the prism plates of the loading table, may be positioned at the correct height between the pressing plates, so that the joint-burn-in rails hit the book in the region of the book joint with a low force and thus can hold the book in place when the loading table moves back down again.

An optional embodiment of the loading table provides that the outline of the book block may be detected with the aid of a signal detector during the loading of the book block and that the drive for the loading table, which comprises a displacement measuring system, is used to move the book block to the correct height.

According to another embodiment, the book block may be already slightly pre-pressed with the aid of the pressing plates belonging to the pressing device, so that the book block can be displaced even before making contact with the reshaping device, such that the forming tool of the reshaping device does not penetrate the cut edge of the book during the displacement of the book block. Following the reshaping, the book shape or form that is created is fixated by increasing the pressure of the joint-burn-in rails and the reshaping device and/or the tool carrier is again moved out from between of the pressing plates.

To achieve during the subsequent pressing operation the best possible joint-burn-in and pressing results for books having a tendency to form folds in the region of the fly leaf, another embodiment may be employed, wherein the sequence pressing/joint-burn-in/pressing, may be used as an alternative to existing pressing sequences of joint-burn-in/pressing and pressing/joint-burn-in.

For this, the pressing device can be configured without problem with several serially arranged stations, which can be provided with an equal number of book blocks. Each station is operated separately with a reshaping device, respectively a tool carrier, wherein a number of side-by-side arranged tool carriers can also be used simultaneously or can be operated intermittently, so as to increase the production.

For the operation of the pressing device as well as the reshaping device, the basic movement sequences can also be machine controlled, freely programmed and/or guided with the aid of at least one sensor.

Insofar as the reshaping device is a wheel-type tool carrier, the forming rails functioning as tools, which generally form an integrated component of the tool carrier, may be arranged on radially outward extending spokes belonging to the tool carrier, wherein these forming rails have a joint axis of rotation with the tool carrier.

This tool carrier, characterized by a rotation, with the forming rails installed in a circumferential direction and arranged tangentially, may be initially operated with a motor utilizing its degrees of freedom and may be moved centrally, relative to the book block held between the pressing plates. In the process and at a sufficient distance to the front cut (in the ideal case the rotational range of the tool carrier with forming rails is completely outside of the pressing device) the forming rail with the required shape for shaping the book block back is respectively advanced rotationally supported.

A control unit may be advantageously used for controlling the precise movement of the tool carrier supporting the forming rails to move between the pressing plates. All data required for this operation may be supplied continuously to this control unit or may be input and stored therein ahead of time. That is true not only for the wheel-type tool carrier described herein, but also for any other tool carrier which can be configured, for example, in the manner of a robot arm.

The dimensions of the book block to be processed serve as the starting point for automatically advancing the appropriate forming rail, in addition, also for the required reshaping of the front edge or the back of the book block. The coordinates for this are usually generated with the aid of a sequence of movements at least in the vertical and horizontal directions, relative to the plane for the front cut. Based thereon, the optimally suited forming rail for the reshaping operation may be activated and/or inserted and/or picked up from among the forming rails stored in the tool carrier.

Once the coordinates of the tool carrier are determined, relative to the front cut of the book block, meaning the critical centricity relative to the front cut has been determined as well as the lift and/or the translational pivoting movement up to the point where the forming rail is placed onto the front cut, only a monotonous movement may be used for the same type of book blocks. That is to say, the tool carrier with the forming rail which operates in the plane respectively moves somewhat out of the range of influence of the pressing plates until the next operation, designed to load in one or several book blocks, whereupon the tool carrier again executes the shaping movement.

The rotor may execute an intermittent rotational movement which may move at least the next, empty pressing device to the loading position, in which at least the following book block is moved between the pressing plates for the reshaping operation and is thus ready for the shaping operation.

If different book blocks follow each other which have differently shaped backs and different dimensions, then a rotating movement is initially executed in addition to the pure lifting movement of the tool carrier, provided it is a rotating tool carrier, until the specified forming rail has been put in place. In addition, a centering of the position of this forming rail takes place, relative to the new book block and/or the corresponding position of the pressing plates.

In case a robot-type tool carrier is used, the tool-carrying part respectively retrieves the matching tool from a tool magazine. In any case, the movement required for shaping the book block back also involves a lowering of the tool carrier substantially in vertical direction.

Owing to the fact that the dimensions of the shaping insert to be used are thus always known, a control unit can ensure that this forming rail does not collide with the pressing plates during the vertical insertion movement since the spacing between the pressing plates is known to the control unit. The centered position of the forming rails, relative to the book block, can be precisely controlled by an essentially horizontal movement of the reshaping device or the tool carrier, which can be adjusted or readjusted automatically.

One advantage of the invention is that with each format change and/or each change in the shape of the book block back, no additional setup times are required and that associated, time-intensive manual operations are omitted.

A new system is thus made available which leads to a substantial increase in productivity, along with maximizing the product quality.

According to a further embodiment of the reshaping device according to the invention, the tool carrier is connected at its rotational center to a shaft that rotates around the axis of rotation, wherein the tool carrier can be provided without problem in its rotational center with a shaft extending outward in the direction of the rotational axis. A coupling flange provided with radial bores for locking the arrangement in place can be positioned on the shaft, or the shaft itself can be provided with locking bores, wherein each locking bore is respectively assigned at a precise angle to one of the forming rails. A locking bolt may be arranged at a right angle to the rotational axis and may be driven such that it can be inserted form-locking into the associated bores, thereby securing the tool carrier system. Of course, other types of locking concepts can also be used.

The tool carrier can also be embodied as a rail arranged above the front cut, either parallel or quasi-parallel, which can be adjusted in at least one plane. At least one tool that can be displaced in at least one plane may be arranged on this rail. If the individual tools are fixedly anchored to the rail, the rail executes corresponding translational movements, if necessary, until the specified tool is in position, wherein kinematic reversals are also possible with respect to the tools.

According to an embodiment, at least one marking is provided for each forming rail belonging to the reshaping device according to the invention. This measure may be supplemented with a locally fixed sensor for detecting the position and confirming the specified forming rail, wherein the system can also comprise the step of detecting information on the precise parallel orientation of the pressing surface of the forming rail, relative to the plane for the front cut.

Owing to the fact that each forming rail comprises a marking and that each forming rail can be mounted on any location on the tool carrier, the rotating tool carrier can be equipped in an optional sequence with different forming rails. In that case, the control unit may automatically identify the sequence in which the forming rails are positioned on the tool carrier. The forming rail used can then be selected with the aid of a program or by pushing a button. A control unit of this type, used for identification, may also be used when robot arms take over the function of the tool carrier for shaping the book block back.

BRIEF DESCRIPTION OF THE DRAWINGS

These and other features and advantages of the invention will be further understood from the following detailed description, with reference to the accompanying drawings. All elements not needed for a direct understanding have been omitted. The same elements in different Figures are given the same reference numbers.

DETAILED DESCRIPTION

Figure 1:
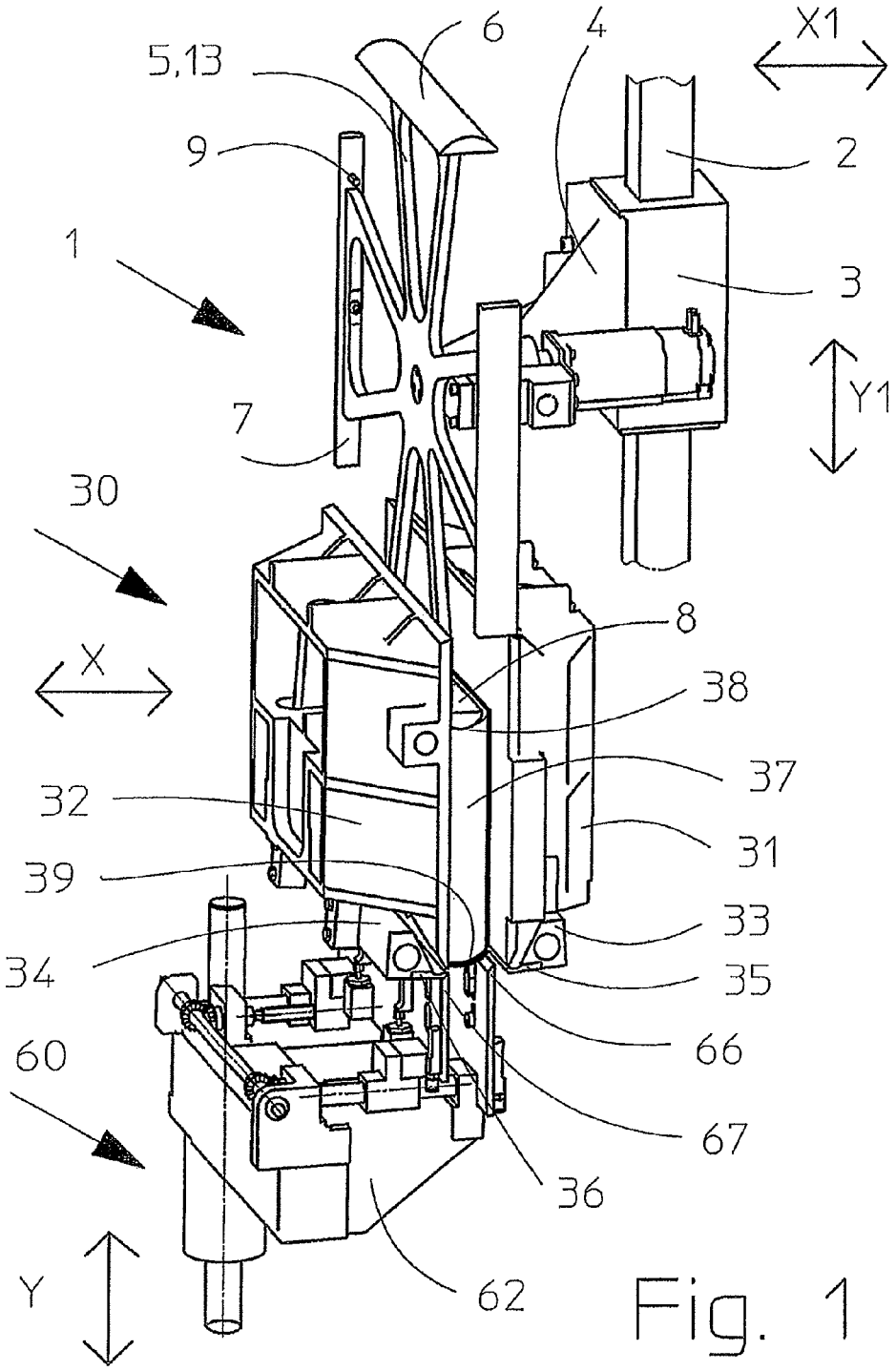
FIG. 1 shows a perspective representation of the book forming and pressing machine according to an embodiment with therein inserted book block.
Figure 2:
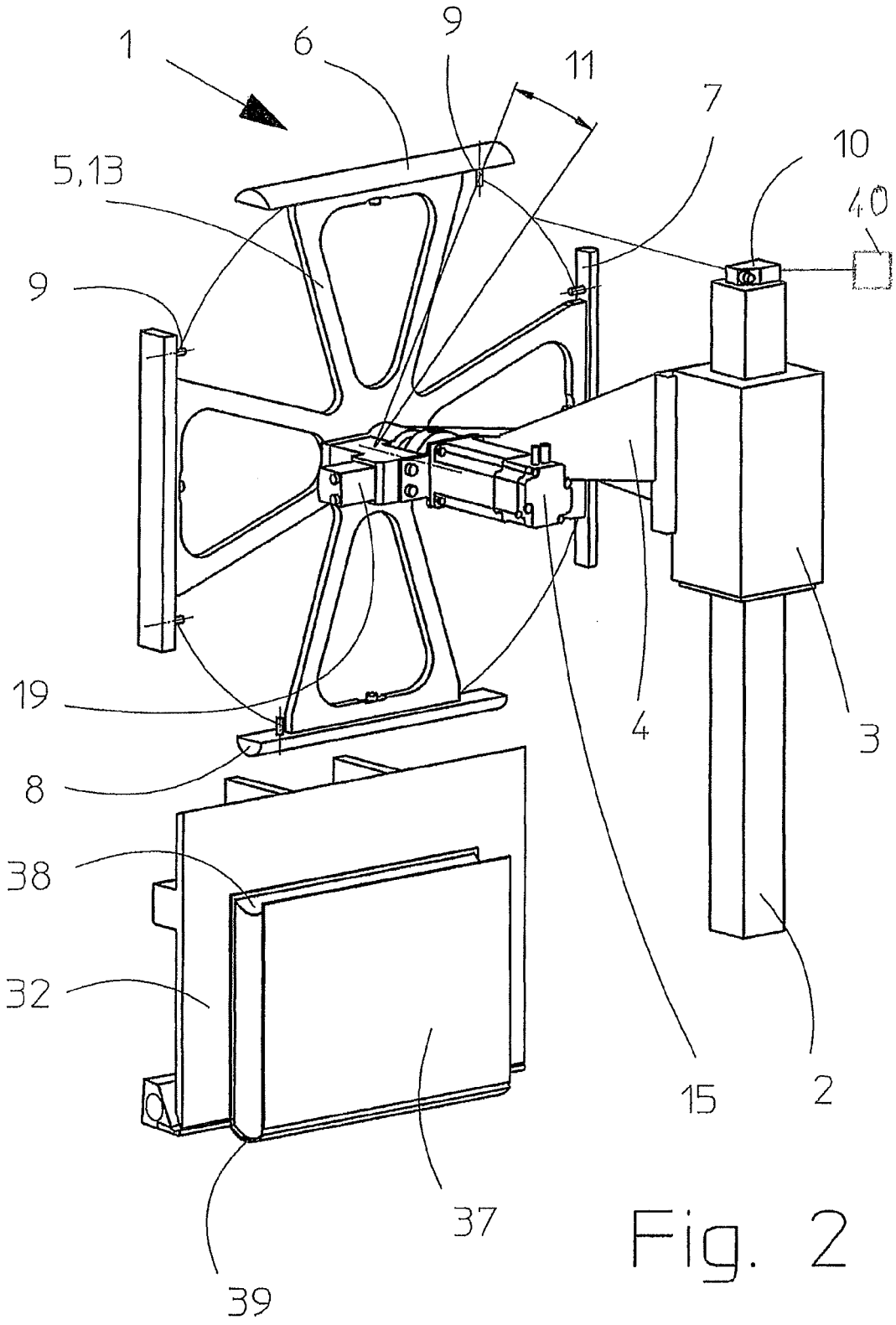
FIG. 2 shows a further perspective view of a reshaping device for the book forming and pressing machine according to FIG. 1, without showing further details of the book forming and pressing machine of which only a schematic illustration of a pressing plate with correspondingly arranged book is shown.
Figure 3:
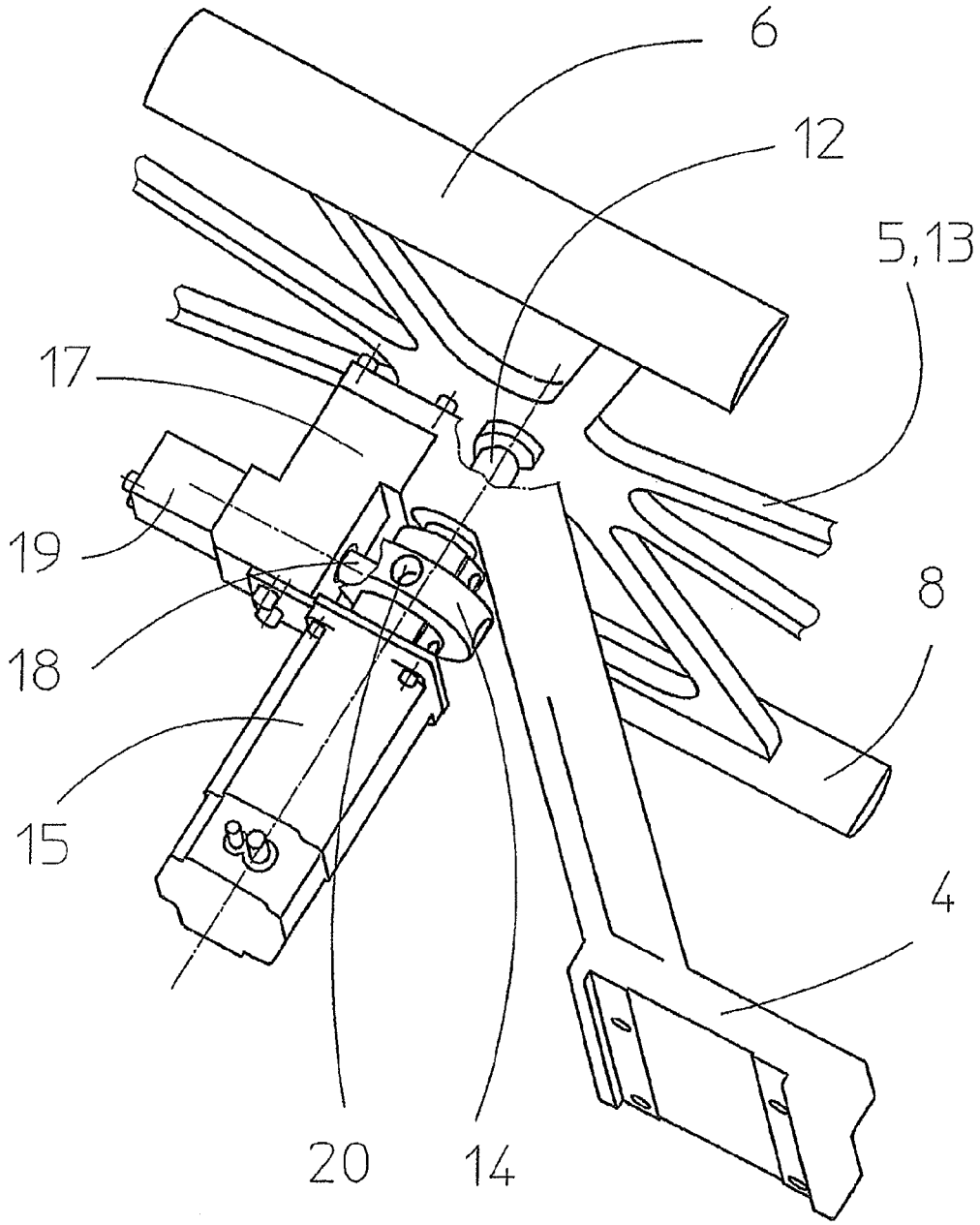
FIG. 3 shows a further perspective view of the reshaping device according to FIG. 2, providing a view of a coupling flange with locking bores.

FIGS. 1 to 3 show a reshaping device 1 according to one embodiment of the invention, wherein the reshaping device 1 in FIG. 1 is installed in a book forming and pressing machine. The book forming and pressing machine is intended to hold in place a book block 37, with the book block back 39 (FIG. 2) pointing downward, between pressing plates 31, 32 on a loading table 62. The representation according to FIG. 1 shows an open side of the book forming and pressing machine with the book block 37 clamped between the pressing plates 31, 32, as shown. As a rule, the book forming and pressing machine may be designed for a vertical orientation of the book block 37. However, this mode of operation is not absolutely required. The information used in the description, relating to top and bottom and/or horizontal and vertical, refer to the standard planes.

FIG. 1 represents a side perspective view from the top to the bottom of a reshaping device 1, a pressing device 30 and a loading device 60. The loading device 60 comprises prism plates 66, 67, arranged parallel to each other in a vertical direction Y, which are facing the book block back 37 and function as support. The prism plates 66, 67 which are in direct contact with the book block back during the operation have a shape which corresponds to the optimum shape for the book block back 39.

With respect to the pressing plates 31, 32 of the pressing device 30, the outer pressing plate 31 is mounted immovably while the inner pressing plate 32 can be adjusted to the correct format with the aid of a horizontal movement X, relative to the book block 37.

Also ensured is a vertical movement Y of the loading device 60, relative to the pressing device 30.

In a lower region of the pressing device 30 and facing the book block back 39, heating bars 33, 34 may be arranged on both sides of the book block 37. The heating bars 33, 34 are used to heat up the joint-burn-in rails 35, 36 which shape the book block 37. The book block 37 has an open front cut 38 to be reshaped, which is arranged opposite the book block back 39 (see FIG. 2).

Above the book block 37, the reshaping device 1 in FIG. 1 is shown a rotating, wheel-type tool carrier 5 which is vertically and horizontally displaceable as indicated by arrows Y1, X1. The tool carrier 5 may comprise radially extending spokes 13 with tangentially arranged forming rails 6, 7, 8 on the outer ends (four forming rails in the present case), which are arranged in pairs opposite each other. The number of forming rails is optional and their distribution over the circumference need not be symmetrical.

The forming rails 6, 7, 8 have curved surfaces, with differing degrees of curvature, and/or flat surfaces which face the front cut 38 of the book block and are available in dependence on the desired configuration of the book blocks 37.

FIGS. 2 and 3 furthermore disclose additional details of the reshaping device 1.

FIG. 2 discloses that the reshaping device 1 can be adjusted vertically by way of a rail/carriage arrangement with a guide rod 2 and a guide carriage 3. A support arm 4 may be attached to the guide carriage 3 and may accommodate a rotating shaft for the tool carrier 5.

FIG. 3 discloses in further detail that the shaft may be positioned centered, relative to the tool carrier 5. The axis of rotation for the shaft 12 thus also forms the axis of rotation for the tool carrier 5, thereby allowing the forming rails 6, 7, 8 to execute a circular movement.

The forming rails 6, 7, 8 may have on the inside one or several marking bolts 9 (FIG. 2), wherein the markings have an operative connection to a sensor 10. For this embodiment of the invention, the sensor 10 may be arranged at an upper end of the guide rod 2, such that the detection of a marking bolt 9 is ensured.

FIG. 3 shows a view from the back of the tool carrier 5 and its rotary drive 15. The tool carrier 5 with its shaft 12 may be positioned rotating in a support arm 4, so that the spokes 13 can be arranged parallel, quasi-parallel or at an angle to the support arm 4, depending on the type of embodiment.

The support arm 4 may include adjacent to the shaft 12 a bearing 17 to accommodate a locking bolt 18. A lifting cylinder 19 may be arranged in the bearing in line with and operating jointly with a locking bolt 18, to activate the locking bolt during operation. In the operating range of the locking bolt 18, a coupling flange or collar 14 may be fitted around the shaft 12 and operatively connected with respect to a rotary drive 15. The coupling flange 14 may include locking bores 20 in its outer surface which bores are oriented radially toward the shaft 12. Alternatively, the locking bores may be provided radially in directly in the shaft 12, thus omitting the coupling flange.

Driven by the connected lifting cylinder 19, the locking bolt 18, which may be arranged at a right angle to the shaft 12 in the region of the coupling flange 14, respectively engages form-locking in a locking bore 20 that is assigned to it.

With the aid of the sensor 10, visible in FIG. 2, the markings on each forming rail may be detected and the traversing angle 11 may be measured and stored. In the representation shown in FIG. 2, the forming rail 8 is located above the front cut 38 of the book block 37, in an operational position. The forming rail 8 may be previously detected with the sensor 10 when the operating position of the forming rail is reached for a corresponding traversing angle 11. The values measured for the traversing angle 11 are transmitted, for example, to a central machine control unit 40 and are compared to desired values, so that the selection of the respectively matching forming rail is ensured once a predetermined format is specified.

As soon as an active position for one of the forming rails 6, 7, 8 is reached, the locking bolt 18 can enter the locking bore 20 in the coupling flange 14 with a radial movement, relative to the shaft 12, so that the operating position for the corresponding forming rail is ensured. The active movement connection between the locking bolt 18 and the lifting cylinder 19 is always operational when it becomes necessary to secure the rotation of the shaft 12, triggered by the rotary drive 15, in a timely manner in the correct position in which the activated locking bolt 18 enters the arriving locking bore 20.

To make sure that the correct forming rail is used, the individual forming rails 6, 7, 8 are provided with one or several markings 9 which cannot be confused, for example with one or several cylinder pins at a respectively different position. If a format change is required, a signal device, for example in the form of a sensor 10, queries the markings 9 during a complete rotational movement of the tool carrier 5, thus identifying each of the forming rails 6, 7, 8 for the operation via the read-out angle of rotation 11, relative to a zero axis.

A variable speed drive then rotates the tool carrier 5 until the active forming rail has reached the operating position above the pressing plates 31, 32, wherein this position is then secured by the locking bolt 18 which can be activated, so as to prevent a further rotation.

This setup procedure can be automated and always takes place outside of the region of movement for the pressing plates 31, 32 which is spatially arranged underneath. The values for the dimensions of the activated forming rail 6, 7, 8, as well as the respective spacing between the pressing plates 31, 32, relative to each other, are stored in the control unit, so as to prevent collisions during the vertical movement of the forming rails during the operation, mindful of the fact that the operatively correct position of the forming rails 6, 7, 8 is determined by the control unit.

With controlled movement sequences of this type, it is no longer necessary to manually adjust or control the centered positioning of the forming rail, relative to the respective dimensioning of the book block 37.

Figure 4:
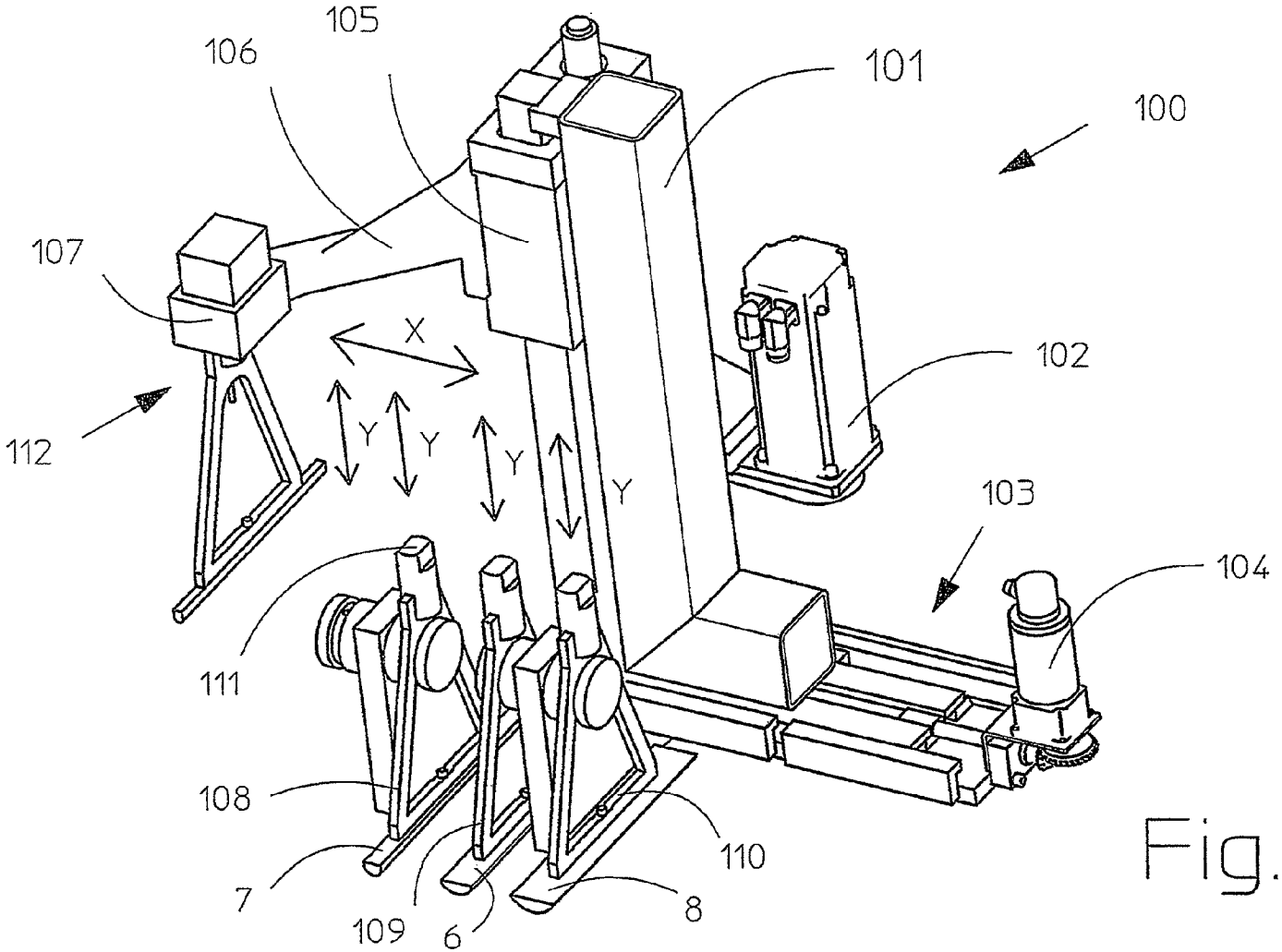
FIG. 4 shows a robot-type device for the tool carrier which is configured with exchangeable tools.

FIG. 4 shows a further option for embodying a tool carrier 100 which is based on a different concept than the wheel-type tool carrier 5 described in FIGS. 1-3. In principle, however, the final shaping of the front cut 38 is the same with the two described variants 5, 100. This tool carrier 100 is configured in the manner of a robot and consists of a column 101 which takes over in vertical direction Y the guidance of a guide carriage 105. An extension 106 is anchored to the guide carriage 105 which supports on its end a tool holder 107. A motor 102 is used to displace the carriage 105 in the vertical direction. The base of the column 101 is anchored to a horizontally displaceable guide carriage 103, wherein a motor 104 is also used to realize this displacement. The extension 106 and the tool holder 107 can be moved in two directions (X, Y). Given these degrees of freedom, the individually embodied tools 108, 109 and 110 can be retrieved directly from a tool magazine for the exchange, with the aid of an automatic coupling mechanism 111/112 as shown in FIG. 4. Once the tool with the respective forming rail has been moved to the operating position, by way of a vertical movement carried out by the extension 106 and in combination with a horizontal translational movement with the carriage 103, the effective shaping of the front cut and/or the back of the book block is carried out with a purely vertical movement of the carriage 105. Here too, the sequence of movements can be controlled by a control unit, based on the same criteria as described for the previously mentioned tool carrier 5. A position-dependent locking mechanism can be provided in this case as well which ensure a stabilizing effect for the sequence of shaping steps.

Figure 5:
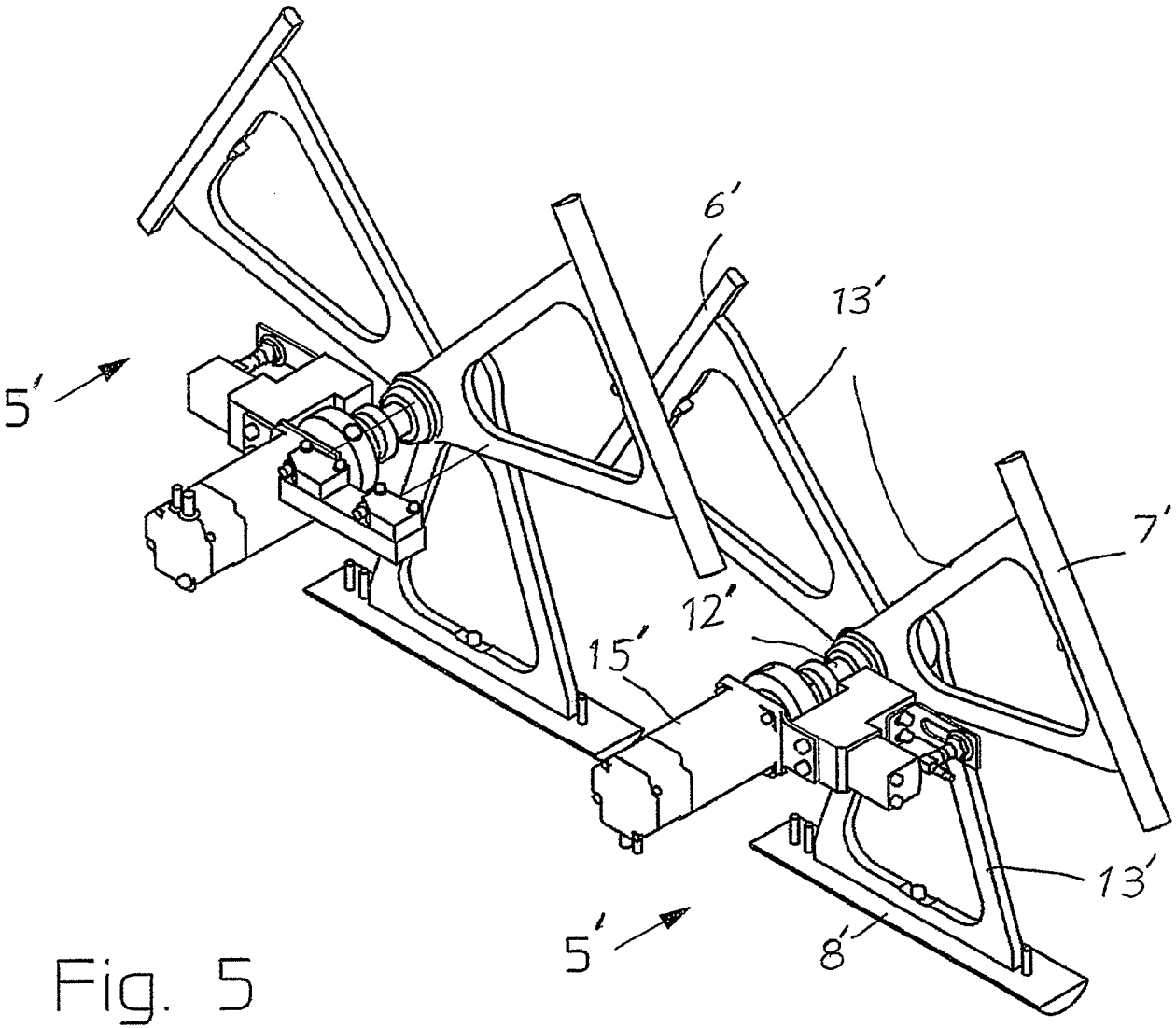
FIG. 5 shows the disposition of several tool carriers, arranged in series, which are operatively connected to a pressing device equipped with several stations.

FIG. 5 shows two tool carriers 5', disposed in series which comprises a different implementation of the rotating, wheel-type tool carrier 5 shown in FIGS. 1-3. As shown in FIG. 5, each forming rail 6', 7', 8' is tangentially attached to an outer end of a separate triangular support 13' that is separately attached to shaft 12' of motor 15'. However, the operation of the rotating tool carrier 5' is similar to that described in FIGS. 1-3.

The series disposition of tool carriers 5' in FIG. 5 is operative in connection with a pressing device which also comprises several sequentially arranged stations (not shown in FIG. 5) for the same number of book blocks. Each station is then serviced individually by a respective reshaping device, respectively by a tool carrier, wherein a number of tool carriers can also be used simultaneously to increase the production or for an intermittent operation. This type of production cadence can furthermore be implemented with robot-type tool carriers 100 illustrated in FIG. 4.

It will be understood that the above description of the present invention is susceptible to various modifications, changes and adaptations, and the same are intended to be comprehended within the meaning and range of equivalents of the appended claims.

What is claimed is:

1. A book forming and pressing machine, comprising:

a pressing device including a number of spaced-apart pressing plates, joint-burn-in rails and at least one station for accommodating a book block;

a loading device including a loading table; and a reshaping device including a mechanism to shape a front cut of a book block, the mechanism including at least one tool carrier to carry at least two different shaping tools to shape the front cut, wherein at least one of the tool carrier and a selected one of the different shaping tools executes a series of movements in one plane or in three-dimensional space, relative to the front cut to be shaped, while the book block is held in the pressing device.

2. The book forming and pressing machine according to claim 1, wherein the pressing device comprises a plurality of sequentially arranged stations to accommodate a corresponding number of book blocks and that at least one of an individual tool carrier, a combination of interdependent operated tool carriers, and a tool is assigned to at least one of the stations.

3. The book forming and pressing machine according to claim 1, wherein the at least two different shaping tools comprise different forming rails.

4. The book forming and pressing machine according to claim 1, wherein the mechanism comprises a robot including the tool carrier and the tool, the robot having movement sequences, paths and angles characterized by at least two degrees of freedom.

5. The book forming and pressing machine according to claim 4, wherein the robot includes a tool magazine storing the at least two different shaping tools that respectively shape the front cut.

6. The book forming and pressing machine according to claim 1, wherein the tool carrier comprises a forming rail that is displaceable in at least one plane and extends parallel to and above the front cut, wherein at least one of the tools that is displaceable in the at least one plane is arranged on the rail.

7. A method for operating a book forming and pressing machine according to claim 1, comprising:

operating the pressing device with at least one station to accommodate a book block;

executing with the tool carrier a sequence of movements in a plane or in three-dimensional space to shape a front cut of the book block with a selected one of the shaping tools, wherein the sequence of movements is one of machine-controlled, freely programmable, or guided by at least one sensor.

8. The method according to claim 7, wherein the executing includes executing with the tool carrier at least one additional translational movement in a direction crosswise to a width of the front cut and carrying out at least one vertical or quasi-vertical shaping movement relative to the front cut.

9. The method according to claim 7, wherein the executing step includes detecting with at least one sensor directly or indirectly at least one information relating to a position of a specified tool and transmitting the information to the control unit.

10. The method according to claim 9, wherein the detecting includes detecting the position of the specified tool in three-dimensional space by the at least one sensor.

11. The method according to claim 7, further including, during a shaping operation, resting the book block on prism plates belonging to a loading table so that the book block is positioned at a specified height between the pressing plates belonging to the pressing device and so that the joint-burn-in rails hit the book block with low force in a region of a book joint; and holding the book block in place during a lowering of the loading table.

12. The method according to claim 11, further including: during a loading of the book block, detecting an outline of the book block; and using a drive to adjust a height of the loading based.

13. The method according to claim 12, further including operating the loading table.

14. The method according to claim 7, further including pre-stressing the book block with the pressing plates during a shaping process and following the shaping process, securing the book block in place by increasing a pressure exerted by the joint rails and subsequently moving the shaping device out of a region of the pressing plates.

15. The method according to claim 7, wherein one of the following pressing sequences are carried out during book block production:

joint-burn-in, then pressing, or pressing, then joint-burn-in, or pressing, then joint-burn-in, then pressing.

16. A book forming and pressing machine, comprising:

a pressing device including a number of spaced-apart pressing plates, joint-burn-in rails and at least one station for accommodating a book block;

a loading device including a loading table; and a reshaping device including a mechanism to shape a front cut of a book block, the mechanism including at least one tool carrier comprising a wheel and a plurality of tools arranged tangentially on the wheel and concentric to the center of the tool carrier, wherein at least one of the tool carrier and the shaping tool executes a series of movements in one plane or in three-dimensional space, relative to the front cut to be shaped, while the book block is held in the pressing device.

17. The book forming and pressing machine according to claim 16, wherein the tools are distributed symmetrically in a circumferential direction on the tool carrier.

18. The book forming and pressing machine according to claim 16, wherein the tool carrier includes form-locking positioning device located in a rotational center region of the wheel to ensure a form-locking position of the tool carrier relative to one of the shaping tools in use.

19. The book forming and pressing machine according to claim 18, further including a shaft connected at the center of rotation of the tool carrier, wherein the form-locking positioning device comprises radially extending locking bores disposed circumferentially around the shaft and a displaceable locking bolt that can be advanced into one of the bores to create a form-locking connection, and that each form-locking connection between a locking bore and a locking bolt defines an operating position for a selected one of the shaping tools.

20. The book forming and pressing machine according to claim 19, wherein the shaft includes the radially extending locking bores.

21. The book forming and pressing machine according to claim 19, further comprising a coupling flange including the radially extending locking bores, wherein the coupling flange is anchored to the shaft.

22. The book forming and pressing machine according to claim 19, wherein the locking bolt is arranged to be advanced toward one of the locking bore while aligned with and at a right angle to or at an acute angle to the shaft.

* * * * *